US005769731A

United States Patent [19]

Reimer

[11] Patent Number: 5,769,731

[45] Date of Patent: Jun. 23, 1998

[54] GOLF COURSE DISTANCE MARKER AND METHOD OF USING THE SAME

[76] Inventor: Thomas H. Reimer, 129 Stanley Rd. 915, Burlinggame, Calif. 94010

[21] Appl. No.: 815,738

[22] Filed: Mar. 12, 1997

[51] Int. Cl.[6] ..... A63B 57/00

[52] U.S. Cl. ..... 473/150; 40/217

[58] Field of Search ..... 423/150, 405, 423/407; 40/217, 612; 52/103, 104; 404/12, 13, 14; 172/19, 20, 37

[56] References Cited

U.S. PATENT DOCUMENTS

| | | | |
|---|---|---|---|
| 3,685,237 | 8/1972 | Johnson | 52/103 |
| 3,688,454 | 9/1972 | Wolfcarius | 52/103 |
| 3,951,212 | 4/1976 | Hallman | 172/19 |
| 4,489,669 | 12/1984 | Carman | 40/217 |
| 5,236,166 | 8/1993 | Darling | 473/150 |
| 5,464,067 | 11/1995 | Dulak | 172/19 |
| 5,532,677 | 7/1996 | Miller | 473/150 |
| 5,593,156 | 1/1997 | Jambor | 473/150 |
| 5,626,525 | 5/1997 | Tolley et al. | 473/150 |

*Primary Examiner*—Steven B. Wong
*Attorney, Agent, or Firm*—David E. Newhouse; Kevin H. Fortin

[57] ABSTRACT

A golf course distance marker suited for anchoring in grassy turf includes a cap, an integral hole stop shoulder, a circumferential blade depending from the outside periphery of the shoulder, and a central anchor stem. Distance data is indicated preferably on one or more, removable, colored coded tabs or colored strips sandwiched between the marker cap and a transparent, removable tabs which snap into and anchor within a pair of slots through the top surface of the cap. The circumferential blade extends downward around the periphery of the marker, so that rotation of the marker rotates the blade to cut into the grassy turf at the location being marked. The anchor stem extends coaxially downward below the circumferential blade to insure axial rotation of the marker as the blade cuts into the turf. Preferably the anchor stem of the invented marker includes an extending helical thread winding around its tip such that rotation of the marker in one direction forces or drives the blade into the turf, while rotation in the opposite direction loosens and lifts the marker from the turf. The hole stop shoulder comprising an inwardly extending annular shoulder at the base of the circumferential blade establishes the depth to which circumferential blade cuts into the turf. The cap includes receptacles for cooperating with a turning tool providing mechanical advantage for twisting the marker about its central anchor stem.

A groundskeeper uses invented marker to cut its own hole and then seats it in the hole with the top surface of its cap flush with the surrounding turf. A turf plug recovered from seating the marker at a new location is used to fill the vacated marker hole.

17 Claims, 4 Drawing Sheets

GOLF COURSE DISTANCE MARKER AND METHOD OF USING THE SAME

1. Field of the Invention

This invention relates to golf course configurations, and more particularly to golf course distance markers.

2. Background of the Invention

Competitive golfers continually strive for improved game scores. Each shot matters. One of the critical factors in making a precise shot is the ability to estimate driving distances to the particular green and the hole located in that green.

It is not uncommon for golf courses to help golfers estimate distances to the greens. A unique shrub in the shrubs and trees typically lining or defining the fairways leading to the greens may be purposefully located (or become known) as a marker indicating the green is approximately 150 yards away. Keen golfers use such markers to estimate their distances away from greens.

Distance markers are also commonly seen in the tee box areas of golf courses which normally consist of three tees: a Pro, a Men's and a Women's. Brightly colored markers identify the area of each tee, behind which, each class of golfer may shoot. The distance between each brightly colored marker and the green is indicated typically indicated by a permanent sign posted next to the tee box. Often the permanent sign will include a depiction of the hole, along with distances from the particular tee to the hole. Such permanent tee box signs assist a golfer to make a proper club selection based on distance and skill level, ideally, resulting in a better (lower) score.

The distance estimates posted on permanent signs are often inaccurate. Cup locations on most greens typically are changed from time to time on most golf courses. Such changes in cup location help to preserve and spread the high use area near the cup around the green. Tee off locations also are changed to allow turf recovery, i.e., to grow and fill in the divots left by an ongoing stream of golfers (or hackers). At many golf courses, both the cup and tee off locations are changed weekly. And because permanent tee off signs are just that, permanent, golf courses do not move or vary the location the tee off box far away from the sign. Accordingly, over time the tee off areas of most golf courses sustain the most wear and tear.

Not only are the permanent sign posted at tee locations inexact because they do not normally account for changes in cup and tee locations, they do not aid a golfer once he or she has teed off and is now out in the fairway driving to the green. Absent the strategic bush, or a fortuitous, (hopefully marked) sprinkler head near by in the fairway, the golfer must guess how far out he is from the green. Such guesses are predicated upon prior experience, (the particular bush), the tee off distances, and the walk or ride from the tee to the ball in the fairway.

Distance estimates also play a crucial role distance in determining which club a golfer chooses in driving to the green. What every golfer desires is a marker both at the tee and in the fairway which accurately indicates the distance out. What is also desired is a quick, convenient, unobtrusive, low impact means of providing golfers with the desired distance data from the various strategic and not so strategic points on a fairway approaching the green.

SUMMARY OF THE INVENTION

A golf course distance marker suited for anchoring in grassy turf includes a cap, an hole stop shoulder, a circumferential blade depending from the outside periphery of the shoulder, and an anchor stem. Distance data is indicated preferably on one or more, removable, colored coded tabs or colored strips sandwiched between the marker cap and a transparent removable tab. The removable tabs snap into and anchor within a pair of slots through the top surface of the cap. The circumferential blade extends downward around the periphery of the marker, so that twisting of the marker about its axis rotates the blade to cut into the grassy turf at the location being marked. The central anchor stem includes a tip section with a coase helical thread which extends downward below the circumferential blade. Rotation of the marker in one direction screws the anchor stem into the turf forcing or driving the circumferential blade to cut into the turf, while rotation in the opposite direction loosens and lifts the marker from the turf. The hole stop shoulder comprises an inwardly extending annular shoulder presenting a support surface at the base of the circumferential blade for establishing the depth to which the central anchor stem and circumferential blade penetrate into the turf.

For placement, the invented marker is twisted or rotated about its axis for driving or screwing its central anchor stem into the turf. The circumferential blade cuts into the turf to a depth determined by the hole stop shoulder. It is then twisted slightly in the opposite direction to loosen it and then is pulled out. The helical threads at the end of the anchor stem retain the circular plug of turf cut free from the surrounding turf within the cylindrical volume surrounded by the circumferential blade. The turf plug is removed and saved, whereupon the marker is placed back in the hole just cut and seated by twisting it with the turning tool for driving or screwing the anchor stem into bottom of the hole. The circumferential blade again cuts into the turf or ground at the bottom of the hole to a depth determined by the hole stop shoulder, the blade and anchor stem securing the seated marker in place at the botton of the hole. For removal the invented marker is twisted in the opposite direction, the helical threads at the tip of the anchor stem lifting the marker from the hole. The hole is then filled with the turf plug saved from the new placement of the marker.

A particular advantage of the invented markers is that the circumferential blade and anchor stem not only cooperated to facilitate cutting a hole in the turf but also facilitate removal of the severed turf plug from the hole. And, that severed turf plug is sized for exactly filling the hole left when relocating the marker.

It also should be appreciated that the width or depth of the blade below the hole stop shoulder is chosen at least equal to the cylindrical height of the marker above the blade base. Accordingly, removal of the severed turf plug not only creates a hole having a size which corresponds to the diameter of the marker but also a depth that corresponds to the height marker when finally seated. Once properly seated, the top cap surface of the marker is located at or slightly below the surface of the surrounding turf and does not interfere with lawn mowing equipment and trimming procedures. The circumferential blade also functionally acts as a plunger holding the seated marker at the bottom the hole.

Another advantage is that the anchor stem, the circumferential blade, the hole stop shoulder and the cap of the invented marker are formed, preferably using injection molding techniques, as a sturdy integial unit of an impact resistant plastic. Preferably the mold plastic includes UL inhibitors lessening photodegradation, is relatively resilient providing impact or shock resistance and is chemically inert. Preferably the thicker annular hole stop shoulder extending between the circumferential blade the cap of the marker is appropriately dimensioned so that when properly seated on the ground surface at the bottom of the hole, it 'floats', structurally supporting the weight of persons stepping on and machines rolling over the cap the marker without driving it deeper into the ground, particularly in moisture softened or muddy terrain.

Another aspect of the invented marker relates to providing spaced grip receptacles shaped for receiving a prong tool enabling the marker to be easily twisted about its axis. It should be appreciated, however, that the grip receptacles may be also be adapted for hand rotation. Preferably, the grip receptacles comprise a pair of cylindrical recesses penetrating into the structure of the hole stop annular shoulder configured to mate with extending spaced apart prongs of a turning tool. The grip receptacles should be symmetrically aligned with respect to the axis of the cap.

These unique features and other advantages afforded by the invented golf course distance marker are more fully explained below in context of drawings showing its the elements and features.

DETAILED DESCRIPTION

Figure 1:
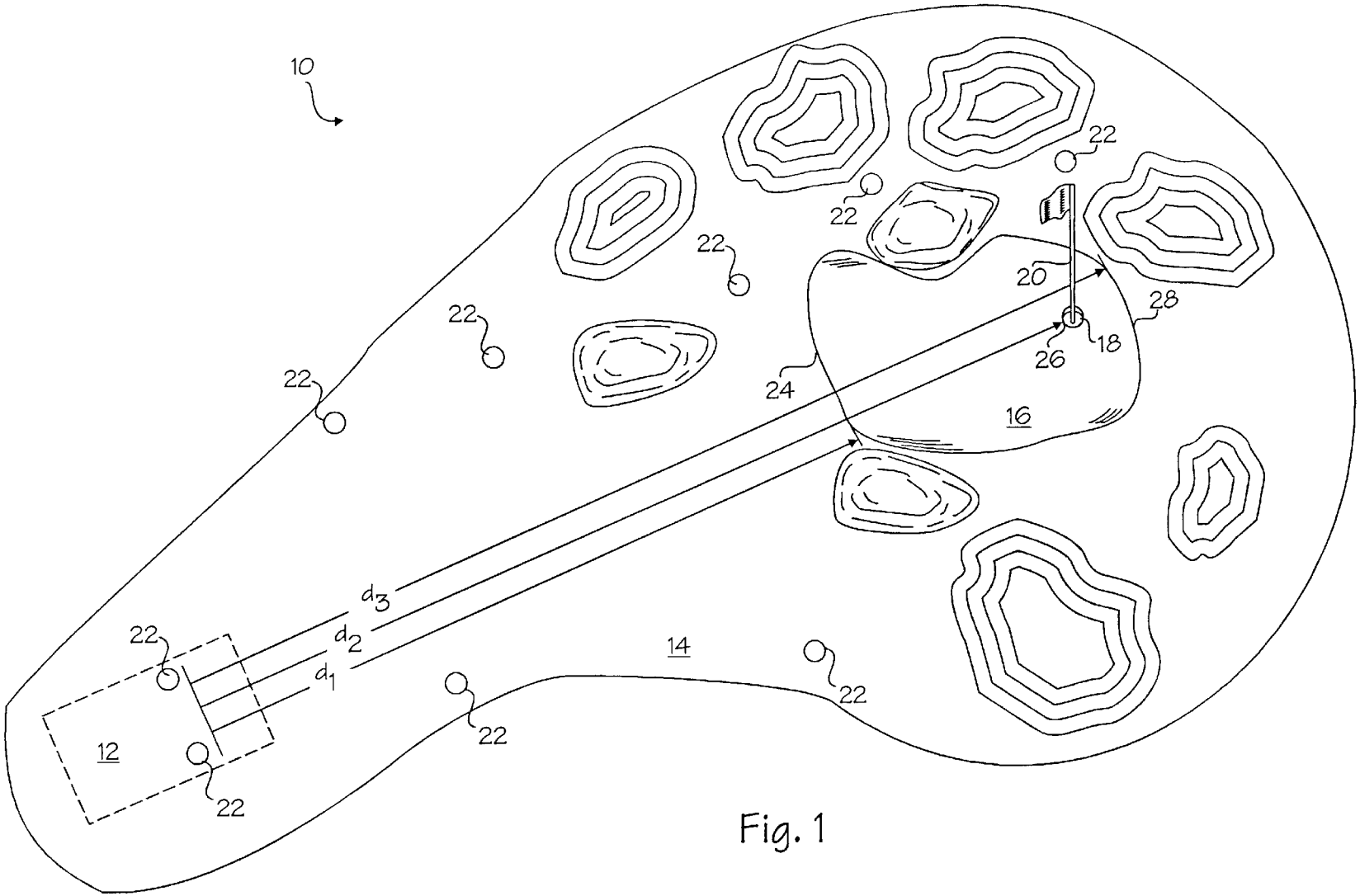
FIG. 1 is a plan view of a golf course having distance markers according to the present invention.

FIG. 1 depicts a single hole of a golf course, generally designated with the reference numeral 10. The hole includes a tee box 12, a fairway 14 and a green 16 with a cup 18. The cup 18 is marked by a flag 20. The tee box 12 includes a pair of distance markers 22. As shown, a plurality of the markers may also be placed either at regular intervals spaced down the fairway and/or at strategic points within or along the fairway. The green 16 has a front 24, middle 26 and a back 28. As drawn, the cup 18 is located near the middle 26 of the green 16. Each distance marker 22 displays a distance dl, to the front 24, d2 to the middle 26, and d3 to the back 28 of the green, respectively.

The markers 22 are easily moved to reflect changes in tee locations. The markers 22 may be placed at Pro, Men's and Women's tees of each tee box 12 on a typical golf course. The markers 22 may be readily moved to reflect changes in the tee and cup locations.

Various uses for the markers 22 of the present invention exist outside golf courses. For example, the invented markers 22 could be used to mark the grids on, rugby, football or a soccer field or a run on a cricket ground. The invented markers 22 may also be useful for assisting groundskeepers line sports fields with chalk and place flags, goal posts, wickets, cones and other sport specific items on the turf.

Figure 2:
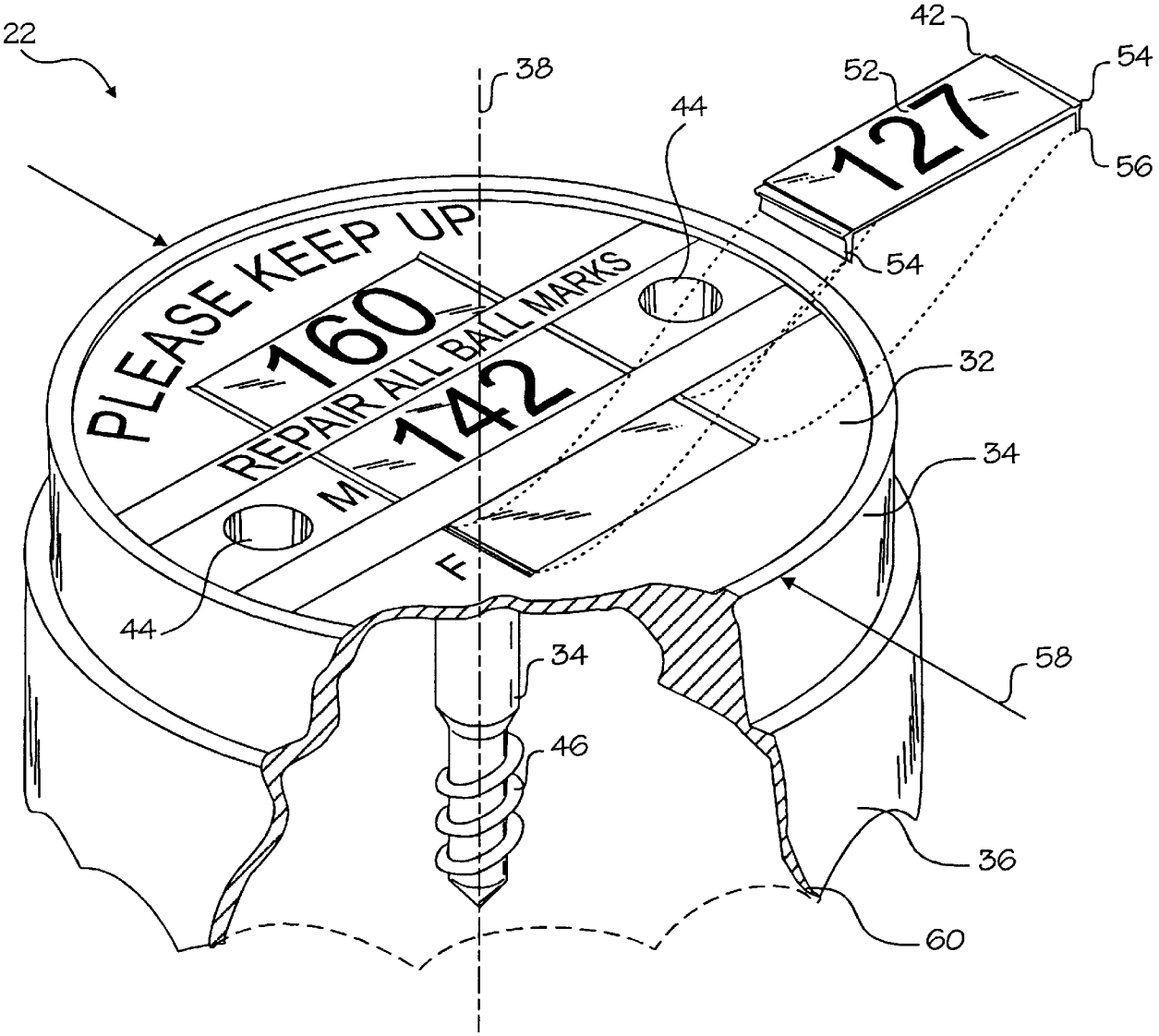
FIG. 2 is a perspective view of an embodiment of a distance marker of FIG. 1.
Figure 4:
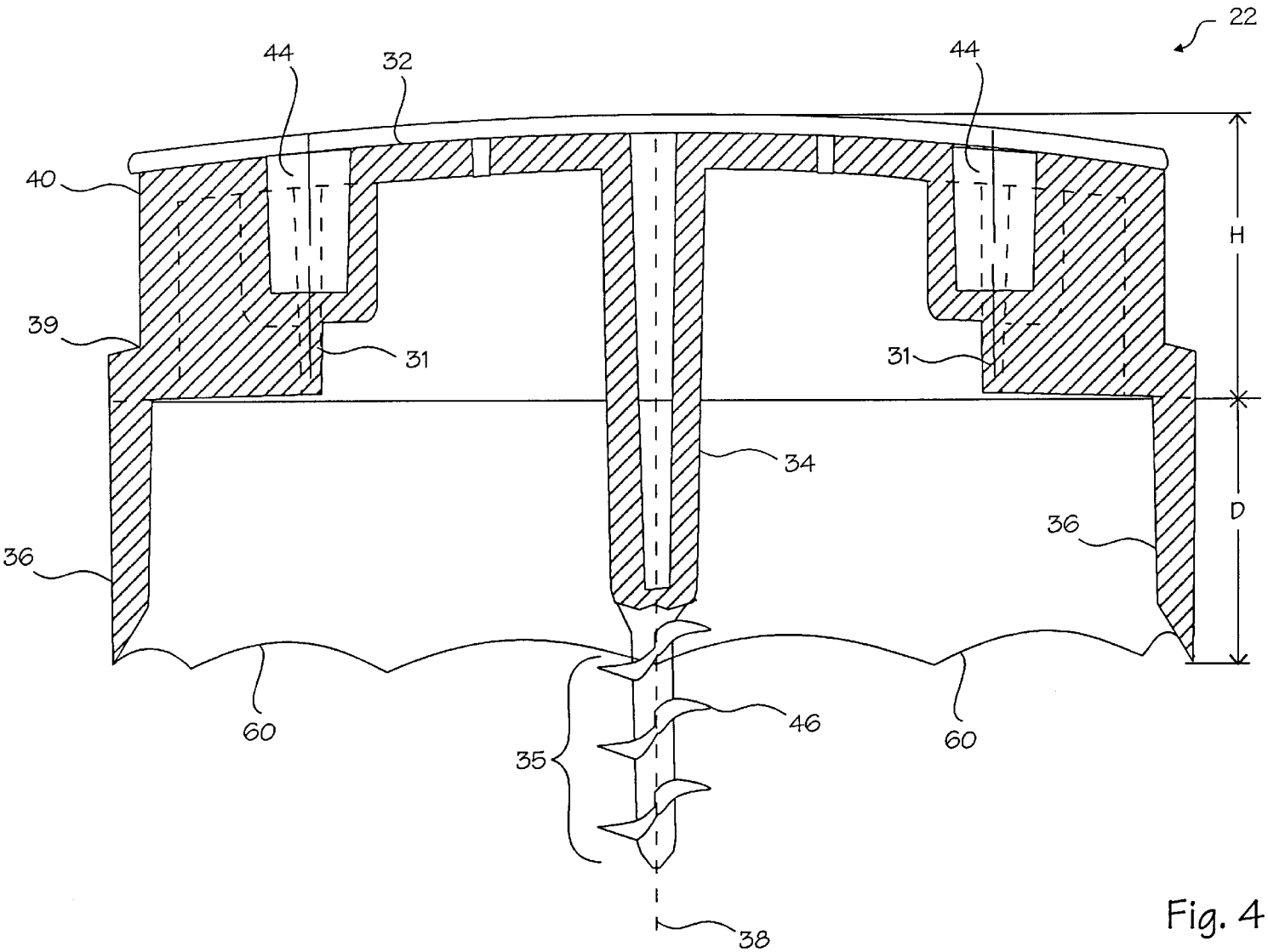
FIG. 4 is a side elevation cross section view of the invented turf distance marker.

FIGS. 2 & 4 show an embodiment of the invented marker 22 which includes a cap 32, an annular hole stop shoulder 31, an anchor stem 34 and a depending curved circumferential blade 36. The marker 22 has a central axis 38, and includes an arcuate periphery 40, snap-in display tabs 42 and a pair of tool grip receptacles 44. The anchor stem 34 has a coarse, radially extending helical threads 46 winding around its tips section 35 below the circumferential blade 36. The circumferential blade 36 is curved and circumscribes the periphery 34 of the marker. The circumferential blade 36 may have a very slight conical taper inward toward the central anchor stem 34.

The pair of grip receptacles 44 are symmetrically aligned with respect to the axis 38 of the marker 22 and receive cooperating prongs 68 of a turning tool 64 (FIG. 3) for rotating the marker 22. The grip receptacles 44 preferably comprise a pair of cylindrical recesses penetrating through the cap 32 partially within the body of the annular hole stop shoulder 31 to provide structural support. The prongs 68 of the turning tool 64 are configured and spaced to be received within the cylindrical recesses 44.

The display tabs 42 have a face 52 and two ends 54. Each end 54 includes an integral anchor clip 56. The clips 56 removable snap into slots 41 through the cap 32 so that distances displayed by the marker 22 may be removed, replaced and updated. In the embodiment drawn the distance data is scribed or embossed on the top face 52 of the display tab 42. Alternatively the display tabs could be composed of clear plastic and distance data scribed on a sheet of material sandwiched between the tab and the cap 32. The display placards 42 in addition to displaying distances to the back 28, middle 26 and front 24 of the green 16, respectively (FIG. 1), may also be color coded, blue black and red and labeled B, M, & F.

In the preferred embodiment, the invented marker is a circular having an outside diameter 58 of approximately 7 inches. The anchor stem 34 extends coaxially down from the cap 32. A coarse, radially extending helical thread 46 located at the tip of the anchor stem 34 the extending below circumferential blade. Rotation of the marker 22 screws the anchor 34 driving the circumferential blade 36 into the turf. Reciprocal rotation of the post lifts the marker 22 from the bottom surface of the cut hole. The circumferential blade 36 may include a serrated edge 60 to aid in sever turf as the blade is driven into the turf. In those instances where the underlying turf or dirt is not sufficiently competent for the helical thread to engage mechanically, the circumferential blade can be urged into the ground with an assisting foot.

Looking at FIGS. 3A-3D, the invented marker 22 is placed in turf 70 by initially twisting or rotating the marker 22 for screwing the course helical thread 46 at the tip of the anchor stem 34 into the turf driving the marker into the ground as indicated by arrows 72. The turning tool 64 includes a handle 66 and a pair of spaced prongs 68 adapted for insertion into the grip receptacles 44. Accordingly, twisting the handle 66 of the turning tool 64 with its prongs 68 received in the grip receptacles will rotate the marker 22 about its axis. In one preferred embodiment, the turning tool 64 comprises two cylindrical bars symmetrically bent and welded together, each bent bar having a horizontal handle section a vertical stem section, a horizontal span section and a vertical prong 68 shaped and sized to be received in the grip receptacle penetrating through the cap 32 of the marker 22. It should be appreciated that the invented marker 22 can be rotated by many different mechanisms each with a particular means for coupling to the marker. In choosing the appropriate mechanism and tool for turning the invented marker, the skilled tool designer should provide one or more step surfaces on the tool adapted for the groundskeeper's foot to provide additional force for driving the marker 22 into the turf and ground.

Initially the anchor stem 34 screws into the turf 70. The circumferential blade 36 then cuts penetrating down to a depth established by the inward extending annular hole stop shoulder 31. The serrated edge 60 facilitates the cutting action of the blade 36 as it is driven into the turf 70 by the force produced by the coarse helical thread 46 as the marker 22 is twisted slowly by the turning tool 64, and/or vertical force provided by an encouraging foot of the groundskeeper. (FIG. 3B) Rotation of the marker 22 as it penetrates into the turf 70 also loosens the engagement of the surrounding (stationary) turf and the outside surface of the circumferential blade 36. Within the cylindrical volume of the circumferential blade 36 the severed turf plug 76 may begin to rotate with the invented marker 22 as it is twisted depending on the root mass of the turf and the integrity or competence of the underlying soil. This is particularly true once the circumferential blade 36 penetrates below the root mass of the turf severing the plug 76 from the surrounding turf 70.

Figures 3A, 3B, 3C, 3D:
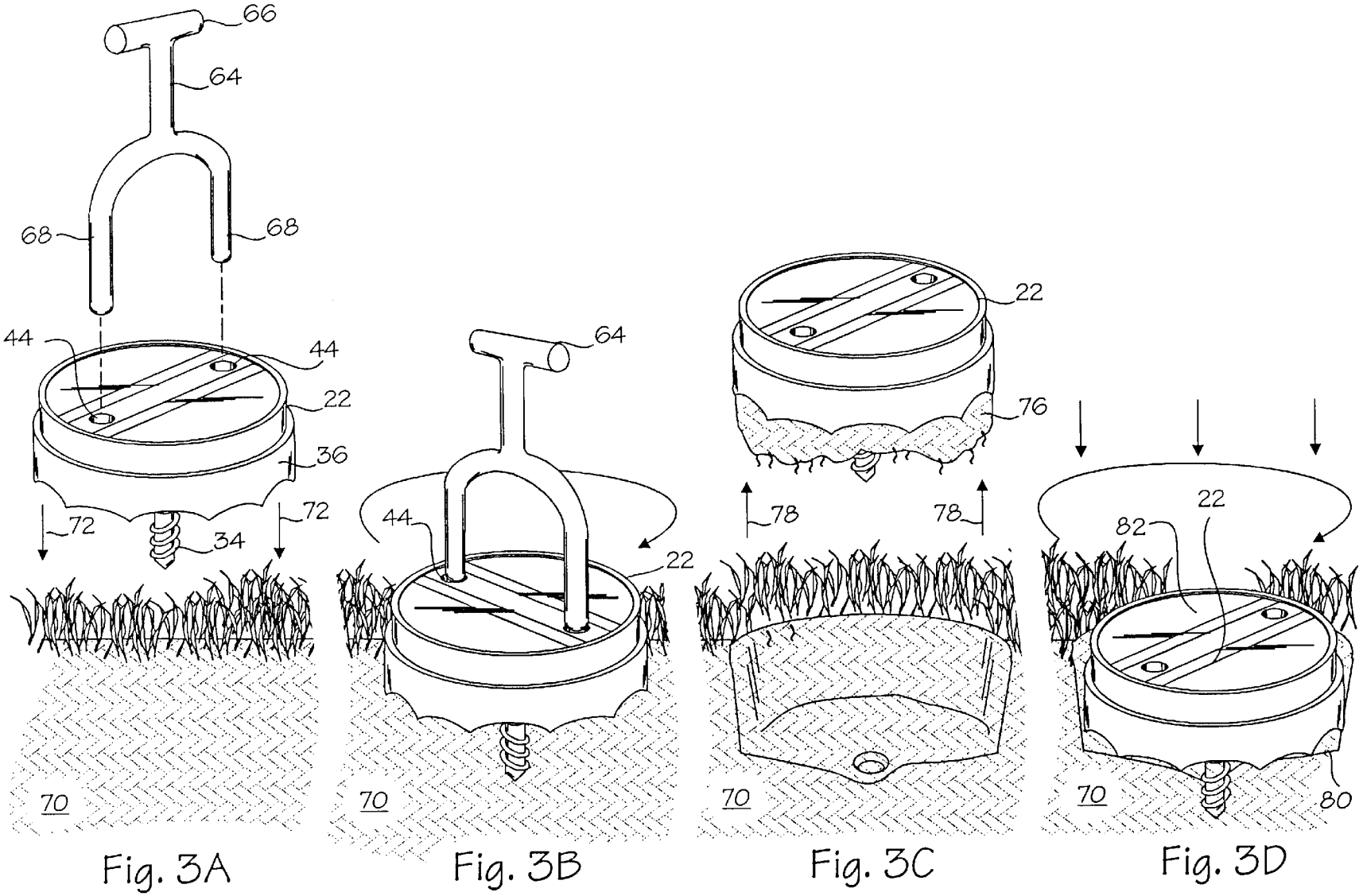
FIG. 3*a*, 3*b*, 3*c*, and 3*d* are side views of the distance marker of FIG. 2 positioning above turf, inserting into turf, removing turf and being seated in the turf, respectively.

Looking now to FIG. 3C, once the marker 22 has penetrated to a depth determined by the hole stop shoulder 31, it is twisted slightly in the opposite direction, and then jerked out carrying the severed turf plug 76 with it. In particular, in competent turf with a solid matted root mass, it is desirable to cut to a depth below the root mass. In such situations, the coarse helical thread 46 engages the root mass of the turf plug 76 as the marker is jerked or pulled from the hole. Accordingly, the severed turf plug 76 lifts with the marker 22 (indicated by the arrows 78). It is then removed from the interior of the marker 22 and saved. The astute groundskeeper should also appreciate that the circumferential blade 36 and integral closed cap 32 cooperate to create a 'suction'or pressure difference within and without the interior volume of the marker 22 tending to keep the turf plug within the interior volume of the marker as it is pulled or jerked from the hole 80. Also a slight inward taper of the circumferential blade 36 will aid in retaining the turf plug within the marker as it is lifted out of the hole. As shown, removal of the severed turf plug 76 with the marker 22 leaves, not surprisingly, a generally cylindrical hole 80 having a diameter equal to that of the marker 22 depth hopefully equal the width 'D' of the circumferential blade (FIG. 4). The removed and saved severed turf plug 76 is preferably used to fill a previous marker location. The plugs 76 may also be placed in similarly sized holes for establishing /enhancing the turf in sparse locations or they may be thrown away.

Looking now at FIG. 3D, once the turf plug 76 has been removed, the marker 22 it is placed back into the hole 80 and, using the turning tool rotated, in the penetrating direction for urging the anchor stem 34 and circumferential blade 36 to screw and cut into the ground at the bottom of the hole 80. As before, where the ground is hard or excessively dry, additional force maybe necessary for urging the marker 22 into the ground. The marker 22 is twisted and rocked until the circumferential blade and anchor stem penetrate to a depth again established by the hole stop shoulder 21, i.e. at the depth where the hole stop shoulder rests on the bottom of the hole 80. At that depth, the top or cap 32 of the marker 22 should lie nearly flush with or slightly below the turf surface. In particular, looking at FIG. 4 the cylindrical height H of the marker 22 above the hole stop shoulder 21 at the base of the circumferential blade 36 is equal or slightly less than the width D the blade 36 which establishes the depth of hole 80.

To remove the invented marker seated in a hole 80, again using the turning tool 64, it is twisted in the opposite direction such that the course helical thread 46 unscrews lifting the marker from the bottom surface of the hole. It is not recommended to pull or jerk the marker from the hole 80 ( even if you could) as is done when initially placing the marker which requires removal of a turf plug 76 allowing the marker 22 to be seated on the bottom of the hole. In particular, when removing the marker 22 it is desirable to leave the sod and dirt at the bottom of the hole in the hole. The rotation for unseating the marker 22 also breaks the 'suction'particularly under moist soil conditions.

The astute groundskeeper should understand and appreciate that the foregoing description of a preferred version of the invented turf marker and its method of use is illustrative and not limiting. There may be a number different embodiments of the invented marker which fall within the scope and spirit of this invention as defined and set forth in the following claims.

I claim:

1. A distance marker for golf courses adapted for seating flush with the surface of the ground, comprising in combination: a) a cap having means on a top surface for displaying information; b) an annular hole stop shoulder integral with and depending down from the cap providing a support surface spaced a distance H below the top surface of the cap; c) a circumferential blade integral with and depending downward from the outside periphery of the annular hole stop shoulder having a width D, the width D is at least equal to the distance H to enable the blade to dig a hole for the distance marker.

2. The distance marker of claim 1 and further including, d) a central anchor stem integral with and extending from the cap coaxially through the annular hole stop shoulder having a tip section coming to a point which extends below the circumferential blade, and wherein the circumferential blade has a generally cylindrical shape.

3. The distance marker of claim 2 wherein the central anchor stem has a coarse helical thread winding around its tip section, whereby rotation of the marker about the axis in one direction screws the anchor stem into the ground, forcing the circumferential blade to cut into the surface of the ground and penetrate to a depth D established upon the support surface of the hole stop shoulder seating on the ground surface, and whereby, rotation of a seated marker in an opposite direction lifts the marker out of the ground.

4. The distance marker of claim 1 wherein the marker is formed from inert, resilient plastic materials having UL inhibitors whereby the marker is resistance to impact, shock, chemical degradation and photo-degradation.

5. The distance marker of claim 2 further including a separate turning tool and wherein the cap includes means for receiving and engaging the turning tool, the turning tool providing mechanical advantage for twisting the marker about its central anchor stem.

6. The distance marker of claim 5 wherein the means for receiving and engaging the turning tool includes a pair of recesses penetrating downward from the top surface of the cap spaced equally on either side of the central anchor stem, the recesses being structurally supported within the annular hole stop shoulder; and wherein the turning tool presents (i) a pair of spaced prongs adapted to mate with and be received in the pair of recesses and (ii) a step surface adapted for placement of a foot of a groundskeeper for imparting vertical force to the marker to aid driving its circumferential blade and anchor stem into the ground.

7. The distance marker of claim 1 wherein the means for displaying information on the top surface of the cap comprises in combination: e) at least one removable tab strip each having a horizontal display surface for presenting information and a pair of integral end clips depending down from opposite ends of the display surface; and f) at least one pair of receiving slots penetrating into the top surface of the cap spaced for receiving and securing the end clips of a tab strip.

8. The distance marker of claim 7 wherein:

(i) each end clip on either end of the display surface of the tab strip includes a raised shoulder at its distal end oriented parallel to the receiving slot in the marker cap, (ii) each receiving slot penetrates completely through the cap, it having a thickness T, communicating with a volume surrounded by the annular hole stop shoulder under the cap; and (iii) each end clip has a length measured from the display surface of the tab strip to the raised shoulder at its distal end at least equal to the thickness T of the cap; whereby, end clips at the respective ends of each display strip snap into the receiving slots.

9. The distance marker of claim 1 further including a plurality of means on the top surface of the cap for displaying information in the form of color, symbols, numerals and text.

10. A golf course, including a tee box, a fairway, a green with a cup, and a plurality of improved distance markers adapted to seat within holes penetrating into a playing surface at the tee box and at a plurality points within the fairway, each comprising in combination; a) a cap having means on a top surface for displaying distance information from the marker to at least one point in the green; b) an annular hole stop shoulder integral with and depending down from the cap providing a support surface spaced a distance H below the top surface of the cap; c) a circumferential blade integral with and depending downward from the outside periphery of the annular hole stop shoulder having a width D, the distance H between the top surface of the cap and the support surface of the annular hole stop shoulder being at most equal to the width D of the circumferential blade; d) a central anchor stem integral with and extending from the cap coaxially through the annular hole stop shoulder having a tip section which extends below the circumferential blade; wherein each distance markers is seated within a hole of a depth D with a bottom, the hole being cut into the playing surface by the circumferential blade of the marker, the support surface provided by the annular hole stop shoulder seating on the bottom of the hole, the anchor stem and circumferential blade respectively penetrating through the bottom of the hole for anchoring the marker in place in the hole.

11. The golf course of claim 10 further including a plurality of means on the top surface of the cap of each marker for displaying distance information in the form of color, symbols, numerals and text from the seated marker to a plurality of points within the green.

12. The golf course of claim 10 further including a plurality of means on the top surface of the cap of each marker for displaying commercial information in addition to giving linear distance information from the seated marker to a plurality of points within the green.

13. The golf course of claim 11 wherein the plurality of means on the top surface of the cap of each marker for displaying distance information displays the linear distance along a straight line from the seated marker to its intersection with a front edge, a midpoint and a back edge of the green.

14. On a turf playing surface, a method of seating a marker flush with the surface of the turf, the marker having: a) a cap with means on a top surface for displaying information; b) an annular hole stop shoulder integral with and depending down from the cap providing a support surface spaced a distance H below the top surface of the cap; c) a circumferential blade integral with and depending downward from the outside periphery of the annular hole stop shoulder having a width D, the distance H between the top surface of the cap and the support surface of the annular hole stop shoulder being at most equal to the width D of the circumferential blade; d) a central anchor stem integral with and extending from the cap coaxially through the annular hole stop shoulder having a tip section coming to a point which extends below the circumferential blade; e) an integral coarse helical thread winding around the tip section of the anchor stem, and f) means integral with cap for cooperating with a turning tool providing mechanical advantage for twisting the marker about its central anchor stem; the steps comprising:

(i) placing the marker with the point of the tip section of its anchor stem on the turf at a marking point;

(ii) twisting the marker with the turning tool rotating it in a first direction for screwing the coarse helical thread winding around the tip of the anchor stem into the turf;

(iii) forcing the circumferential blade to cut into the turf playing surface by continued twisting of the marker with the turning tool in the first direction to a depth D determined by the support surface of the hole stop shoulder seating on the turf playing surface;

(iv) lifting the marker from the turf surface trapping a turf plug within a volume circumscribed by the circumferential blade above the coarse helical thread leaving a hole with a bottom at depth D below the turf playing surface;

(v) removing the turf plug from the volume circumscribed by the circumferential blade of the marker;

(vi) placing the marker back into the hole just cut; and (vii) twisting the marker again with the turning tool rotating the marker in the first direction forcing the helical thread to screw and the circumferential blade to cut into the bottom of the hole again to a depth D determined by the hole stop shoulder seating on the bottom of the hole for anchoring the marker.

15. The method of claim 14 and a further step of twisting the marker slightly in an opposite direction with the turning tool for both loosening the turf plug cut by the circumferential blade and loosening engagement of the coarse helical thread with turf penetrated below the blade before lifting the marker from the turf surface.

16. The method of claim 14 further including the steps of relocating the marker to a new location comprising:

(viii) twisting the marker in an opposite direction with the turning tool unscrewing the helical thread from engagement with turf penetrated into at the bottom of the hole lifting the marker up from the bottom of the hole;

(ix) removing the marker from the hole and placing the marker with the point of the tip section of its anchor stem on the turf at a new marking point;

(x) repeating steps (ii) through (v); and (xi) placing the turf plug obtained from the new location in the hole just vacated filling the vacated hole.

17. A distance marker as set forth in claim 1, wherein the width D is generally equal to the distance H so that the marker is adapted for removing a turf plug and for seating flush with the ground after removal of the turf plug.

* * * * *